US008155565B2

(12) United States Patent
Akedo

(10) Patent No.: US 8,155,565 B2
(45) Date of Patent: Apr. 10, 2012

(54) DEVELOPING DEVICE WITH A TONER FLOW GUIDE PLATE AND IMAGE FORMING APPARATUS

(75) Inventor: Shuichi Akedo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 410 days.

(21) Appl. No.: 12/484,285

(22) Filed: Jun. 15, 2009

(65) Prior Publication Data

US 2009/0324299 A1 Dec. 31, 2009

(30) Foreign Application Priority Data

Jun. 30, 2008 (JP) ..... 2008-171195

(51) Int. Cl.
*G03G 15/08* (2006.01)

(52) U.S. Cl. ..... 399/254; 399/274

(58) Field of Classification Search ..... 399/254, 399/274

See application file for complete search history.

(56) References Cited

U.S. PATENT DOCUMENTS

| | | | | |
|---|---|---|---|---|
| 4,025,179 | A * | 5/1977 | Hudson | 399/254 |
| 4,700,659 | A * | 10/1987 | Hirakura et al. | 399/254 |
| 5,091,749 | A | 2/1992 | Iida et al. | |
| 5,189,474 | A * | 2/1993 | Miya et al. | 399/255 |
| 7,620,351 | B2 * | 11/2009 | Onda et al. | 399/274 |
| 7,702,261 | B2 * | 4/2010 | Yasuda | 399/254 |
| 2007/0025777 | A1 * | 2/2007 | Tomita et al. | 399/274 |
| 2007/0071507 | A1 * | 3/2007 | Onda et al. | 399/274 |
| 2008/0170876 | A1 * | 7/2008 | Sakai et al. | 399/93 |
| 2009/0041506 | A1 | 2/2009 | Akedo | |
| 2009/0245888 | A1 * | 10/2009 | Akedo | 399/276 |

FOREIGN PATENT DOCUMENTS

| | | | |
|---|---|---|---|
| JP | 61015166 | A * | 1/1986 |
| JP | 62006284 | A * | 1/1987 |
| JP | 62-050860 | A | 3/1987 |
| JP | 62050860 | A * | 3/1987 |
| JP | 01003682 | A * | 1/1989 |
| JP | 3-39766 | A | 2/1991 |
| JP | 3-175473 | A | 7/1991 |
| JP | 03168778 | A * | 7/1991 |
| JP | 2002-207366 | A | 7/2002 |
| JP | 2006-154235 | A | 6/2006 |
| JP | 2006-235376 | A | 9/2006 |
| JP | 2009-42674 | A | 2/2009 |

* cited by examiner

*Primary Examiner* — David Gray
*Assistant Examiner* — G. M. Hyder
(74) *Attorney, Agent, or Firm* — Nixon & Vankerhye P.C.

(57) ABSTRACT

A developing device for developing an electrostatic latent image formed on an photoreceptor drum with a dual-component developer, includes: a developing hopper for storing the developer; an agitation roller for conveying the developer while agitating; a developing roller which supplies the developer to a developing area located opposing the photoreceptor drum; a layer thickness-regulating member for regulating the layer thickness of the developer being conveyed by the developing roller; a flow-guide plate for flowing down the surplus developer that was rejected to a position away from the layer thickness-regulating member; a multiple number of partitioning ribs arranged upright on the flow-guided plate for flowing down the surplus developer in a predetermined direction while diffusing the developer with respect to the longitudinal direction of the developer roller; and a downflow direction control mechanism for controlling the downflow direction of the surplus developer regulated by the partitioning ribs.

6 Claims, 8 Drawing Sheets

Print Pattern B
(Coverage Ratio 25%)

Print Pattern A
(Coverage Ratio 12.5%)

*FIG. 8*

Table 1: Relationship between Set Conditions and Evaluation on Image Quality in Examples and Comparative Examples

| Examples | Print pattern (print coverage %) | Developing roller's continuous drive time (min) | Developing roller's rotational speed (mm/sec) | Inclined angle θ of partitioning ribs (°) | Addition of reciprocation of partitioning ribs (count/min) | Toner conc. Difference in developing hopper between the front and rear sides (wt% in absolute value) | Evaluation on image quality (print density) |
|---|---|---|---|---|---|---|---|
| Example 1 | 12.5 | 5 | 864 | 10 | — | 0.08 | 0.06 |
| Example 2 | 25 | 5 | 864 | 20 | — | 0.09 | 0.09 |
| Comparative Example 1 | 12.5 | 5 | 864 | None | — | 0.38 | 0.13 |
| Comparative Example 2 | 25 | 5 | 864 | None | — | 0.67 | 0.20 |
| Example 3 | 25 | 15 | 432 | 10 | — | 0.06 | 0.05 |
| Comparative Example 3 | 25 | 15 | 432 | None | — | 0.21 | 0.08 |
| Example 4 | 12.5 | 30 | 864 | 20 | 2 | 0.08 | 0.09 |
| Example 5 | 12.5 | 60 | 864 | 20 | 4 | 0.07 | 0.06 |
| Example 6 | 12.5 | 60 | 864 | 20 | — | 0.08 | 0.09 |

DEVELOPING DEVICE WITH A TONER FLOW GUIDE PLATE AND IMAGE FORMING APPARATUS

This Nonprovisional application claims priority under 35U.S.C. §119 (a) on Patent Application No. 2008-171195 filed in Japan on 30 Jun. 2008, the entire contents of which are hereby incorporated by reference.

BACKGROUND OF THE TECHNOLOGY (1) Field of the Technology

The present technology relates to a developing device and an image forming apparatus for visualizing an electrostatic latent image formed on a photoreceptor etc. with a developer, in particular relating to a developing device and an image forming apparatus including an agitating mechanism for dual-component developer composed of toner and carrier.

(2) Description of the Prior Art

The developing device using a dual-component developer in an image forming apparatus such as a digital multifunctional machine or the like incorporates a developing roller opposing a photoreceptor, an agitating roller and a toner supply and agitation roller, all being arranged rotatably in the developing hopper. Formed over the toner supply and agitation roller is a toner supply port, over which a toner supply container is attached.

An excess of developer that was separated from the developing roller by the layer thickness-regulating member inside the developing hopper passes by a flow-guide plate arranged nearby and is returned to the upside of the agitating roller. This surplus developer is mixed and agitated with the supplied toner and then fed once again to the developing roller. Further, there are many cases that the flow-guide plate is formed with partitioning ribs in order to prevent occurrence of uneven distribution of the developer inside the developing hopper.

In the prior art, since partitioning ribs 347 formed on the flow-guide plate do not move as shown in FIG. 1, the surplus developer that was separated by an unillustrated layer thickness-regulating member will not move in the longitudinal direction of the developing roller, designated at 341 and is returned sliding over a flow-guide plate 346 to the upside of an unillustrated agitating roller. For this reason, agitation of the developer in the longitudinal direction of developing roller 341 relies on the rotation of the agitating roller alone, hence there occurred many cases where it takes long time for agitation or where a lack of agitation takes place.

As a countermeasure to deal with this problem, a patent document 1 (Japanese Patent Application Laid-open 2006-154235) discloses a technique in which the developer returned from the flow-guide plate and the toner supplied from above are made to pass through an AC magnetic field generator so as to improve agitating and mixing performance.

In recent high-speed digital multi-functional machines, there are cases that image unevenness occurs when printing of the same print pattern has been continuously performed. That is, in a dual-component developing device, the dual-component developer that is assumed to have a uniform toner concentration, is supplied to the developing roller using the agitating roller and the like so as to make the toner concentration uniform along the longitudinal direction of the developing roller. However, in the real situation, the amount of toner consumed from the developing roller is different depending on the print pattern, so that the toner concentration on the developing roller surface after development becomes different with respect to the aforementioned longitudinal direction.

In this situation, when the toner concentration of the developer supplied to the developing roller is not uniform in the longitudinal direction, the toner concentration of the developer contributing to development resultantly becomes different across the length of the developing roller. This problem is particularly prone to occur for the developing roller that rotates at a high speed.

For example, when print patterns having a black solid area in the central part have been continuously printed, the toner concentration of the developer has become lowered in the center across the length of the developing roller, hence causing image unevenness such that the necessary print density cannot be obtained. As a result, there occurs a large difference in the toner concentration of the dual-component developer between before and after it is agitated and mixed in the agitating roller area, hence the toner concentration will remain uneven across the length of the developing roller even when the developer is supplied to the developing roller. Accordingly, the surplus dual-component developer is also different in toner concentration along the length of the developing roller when viewed microscopically.

Also, when print patterns having gradually changing printing ratios along the longitudinal direction of the developing hopper have been continuously printed, the toner concentration becomes different between the far and near sides across the length of the developing roller, hence making the images uneven or different in print density. As a result, there occurs a large difference in the toner concentration of the dual-component developer between before and after it is agitated and mixed in the agitating roller area, hence the toner concentration will similarly remain uneven across the length of the developing roller when the developer is supplied to the developing roller. Accordingly, the surplus dual-component developer is also different in toner concentration along the length of the developing roller when viewed microscopically.

However, the developing device disclosed in the aforementioned patent document 1 is constructed to focus on crushing toner aggregations, but the toner concentration across the length of the developing roller is not taken into consideration. Further, since this configuration takes such a structure that the developer is dropped through one place into the developing hopper, there has been the problem that it takes long time to make the toner concentration uniform.

SUMMARY OF THE TECHNOLOGY

The present technology has been devised in view of the above problems entailing the conventional developing devices, it is therefore an object of the present technology to provide a novel and improved developing device and image forming apparatus with which a dual-component developer of uniform toner concentration across the length of the developing roller can be quickly supplied.

In order to achieve the above object, the first aspect of the present technology resides in a developing device for developing an electrostatic latent image formed on an image bearer with a developer that has been triboelectrically charged by mixing and agitation of two components, toner and magnetic carrier, comprising: a developing hopper for storing the developer; an agitation and conveying member that is rotationally driven inside the developing hopper for conveying the developer while agitating; a developer support which supports the developer that has been mixed and agitated inside the developing hopper and supplies the developer whilst being rotationally driven to a developing area located opposing the image bearer; a layer thickness-regulating member for regulating the layer thickness of the developer being conveyed by the developer support; a flow-guide plate member for flowing down the surplus developer that was rejected by the layer thickness-regulating member to a place located away from the layer thickness-regulating member; a plurality of diffusing elements arranged upright on the flow-guide plate member for flowing down the surplus developer in a predetermined direction whilst diffusing the developer with respect to the longitudinal direction of the developer support; and a downflow direction control mechanism for controlling the downflow direction of the surplus developer by the diffusing elements, in accordance with the coverage ratio of black solid area in print documents with respect to the longitudinal direction of the developing hopper.

With the above configuration, the downflow direction of the surplus developer that is collected by the flow-guide plate and flows down over it is changed by the diffusing elements, i.e., the partitioning ribs formed on the flow-guide plate, by means of the downflow direction control mechanism. Accordingly, the surplus developer flowing down is made to fall in one direction relative to the length direction of the developing roller as the developer support. By making a greater amount of the surplus developer fall down to the area in the developing hopper where toner concentration is prone to be higher, it is possible to increase the amount of developer and hence improve mixing and agitation performance and enhance performance of conveying toner to the area where toner concentration is prone to be low. As a result, it is possible to make toner concentration uniform with respect to the longitudinal direction of the developing roller, hence prevent image unevenness originating from insufficient agitation of the toner and developer.

The second aspect of the present technology resides in the developing device having the above first aspect, wherein the downflow direction control mechanism is controlled such that the angle of the downflow direction that is regulated by the diffusing elements is made greater in accordance with the rotational speed of the developer support.

It is usual that the rotational speed of the developing roller is changed with the change of the processing speed of print paper in image forming. Though the mixing and agitation performance of the dual-component developer lowers with the increase of the processing speed, it is possible to make the toner concentration uniform with a higher precision by increasing the inclined angle of the downflow direction that is regulated by the downflow direction control mechanism, in the above manner.

The third aspect of the present technology resides in the developing device having the above first or second aspect, wherein the diffusing element is formed such that the height from the surface of the flow-guide plate member on which the diffusing element is set becomes smaller as it goes in the downflow direction.

It is usual that in the rear half of the partitioning ribs that is away from the layer thickness-regulating member, the surplus developer has been rather mixed and made substantially even within each passage between the partitioning ribs. Accordingly, the formation of the partitioning ribs such that their height becomes lower in the rear half enables the surplus developer in adjacent passages between partitioning ribs to mix up, hence it is possible to make the toner concentration uniform with a higher precision.

The fourth aspect of the present technology resides in the developing device having any of the above first through third aspects, further including a toner concentration uniforming mechanism of flowing down the surplus developer while reciprocating the downflow direction control mechanism every time the continuous drive time of the developer support exceeds a predetermined period of time.

Though it is usual that the fluidity and mixing and agitation performance of the dual-component developer become lowered as use of the developer becomes longer, it is possible to make the toner concentration uniform with a higher precision when the downflow direction by the partitioning ribs is made to reciprocate temporarily in accordance with the continuous drive time of the developing roller.

The fifth aspect of the present technology resides in the developing device having any of the above first through fourth aspects, further comprising a toner concentration detector that is arranged in the proximity to the area where the developer is supplied from the agitating and conveying member to the developer support, to detect the toner concentration of the developer.

Since provision of the toner concentration sensor immediately before bringing up the developer to the developing roller enables detection of the toner concentration directly before development, it is possible to realize high image quality over a long period of time.

Additionally, in order to solve the above problems, the sixth aspect of the present technology resides in an image forming apparatus including an image bearer for supporting an electrostatic latent image, and a developing device having any one of the above first to fifth aspects for visualizing the electrostatic latent image on the image bearer with toner.

Since the above configuration makes it possible to improve mixing and agitation performance in the developing hopper by uniformly dispersing the surplus developer collected over the flow-guide plate, it is possible to prevent image unevenness originating from the developing device by making toner concentration uniform across the length of the developing roller.

The seventh aspect of the present technology resides in the image forming apparatus having the above sixth aspect, further including an image density detector for detecting the density of a toner patch on the image bearer.

Since provision of an image density detecting means for detecting the density of a toner patch on the image bearer enables detection of the density of the actually developed image, it is possible to realize high image quality over a long period of time, by feeding back that measurement to the downflow direction control mechanism.

As has been described, according to the present technology, the surplus developer separated by the layer thickness-regulating member can be unevenly distributed to one side with respect to the length of the developing roller by turning the downflow of the surplus developer to a designated direction using the movable partitioning ribs on the guide-flow plate. Accordingly, it is possible to improve agitation and mixture of the surplus developer and supplied toner and hence suppress image unevenness originating from imbalance of printing originals with respect to the longitudinal direction of the developing roller.

DESCRIPTION OF THE PREFERRED EMBODIMENTS

The preferred embodiment of the present technology will hereinafter be described in detail with reference to the accompanying drawings.

Figure 1:
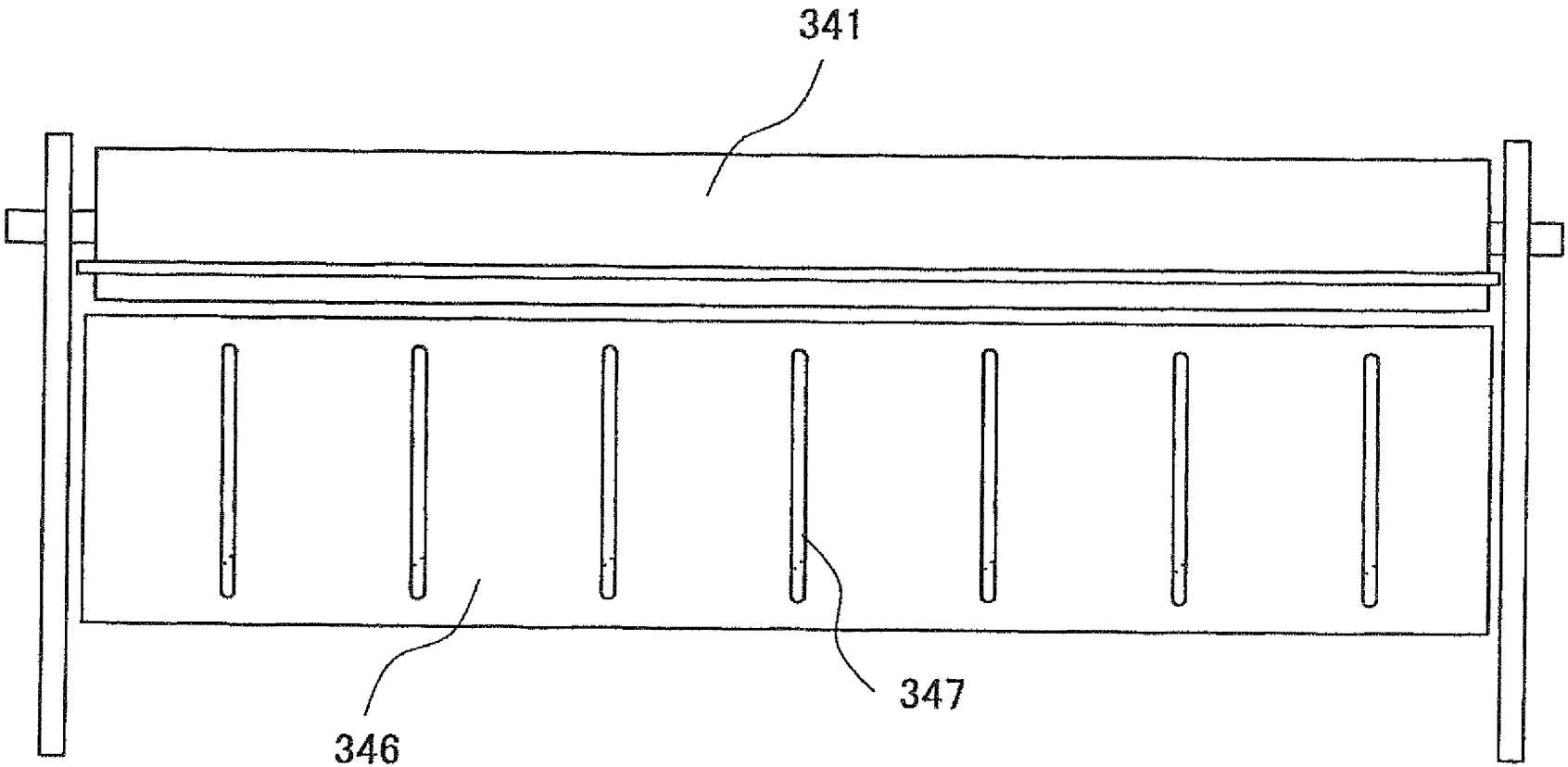
FIG. 1 PRIOR ART
FIG. 1 is a top illustrative view showing a conventional developing device configuration having partitioning ribs.
Figure 2:
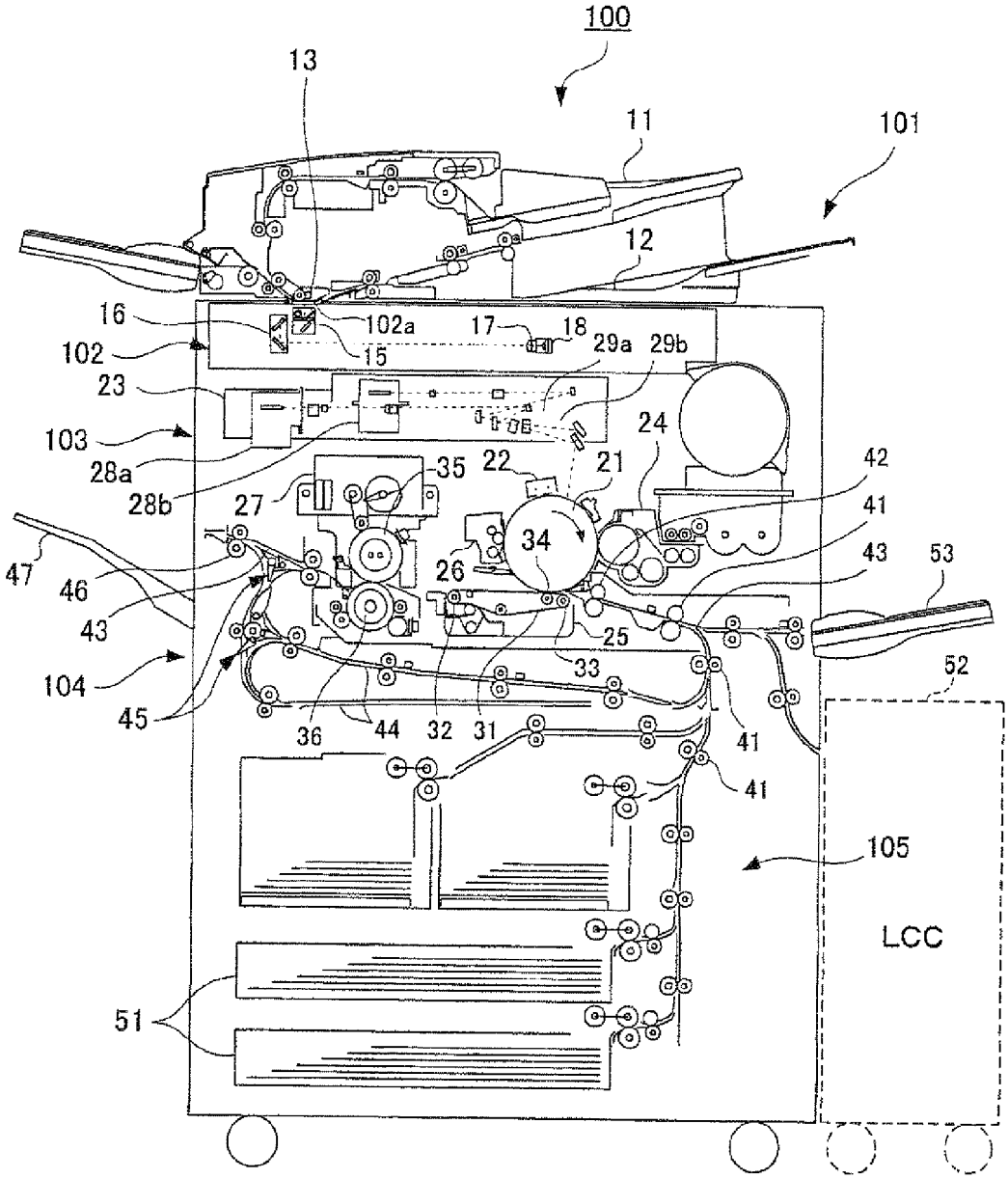
FIG. 2 is an illustrative view showing a configuration of an image forming apparatus according to the first embodiment of the present technology.

FIG. 2 is an illustrative view showing a configuration of an image forming apparatus according to the first embodiment of the present technology.

Here, in the description and drawings, the constituents having essentially the same functional configurations will be allotted with the same reference numerals to omit repeated description.

To begin with, the overall configuration of an image forming apparatus to which the first embodiment of the developing device of the present technology is applied will be described with reference to the drawing.

An image forming apparatus 100 of the present embodiment is to form on a recording paper a monochrome image represented by the image data that was obtained, for example by scanning a document or that was received from without, and is essentially comprised of a document feeder (ADF) 101, an image reader 102, a printing portion 103, a recording paper conveyor 104 and a paper feeder 105.

In document feeder 101, when, at least, one document is set on a document set tray 11 and the documents are pulled out from document set tray 11, sheet by sheet, the document is conducted to and passed over a document reading window 102*a* of paper reader 102 and discharged to a document output tray 12.

A CIS (contact image sensor) 13 is arranged over document reading window 102*a*. This CIS 13 repeatedly reads the image on the rear side of the document in the main scan direction while the document is passing over document reading window 102*a*, to thereby output the image data that represents the image on the rear side of the document.

Further, image reader 102 illuminates the document surface with light from the lamp of a first scan unit 15 when the document passes over document reading window 102*a* and the reflected light from the document surface is lead to an image focusing lens 17 by way of the mirrors of first and second scan units 15 and 16, so that the image on the document surface is focused by image focusing lens 17 onto the a CCD (charge coupled device) 18. CCD 18 repeatedly reads the image of the document surface in the main scan direction to thereby output image data that represents the image on the document surface.

On the other hand, when the document is placed on the platen glass on the top of image reader 102, first and second scan units 15 and 16 are moved keeping a predetermined speed relationship relative to each other while the document surface on the platen glass is illuminated by first scan unit 15, and the light reflected off the document surface is lead to image focusing lens 17 by means of first and second scan units 15 and 16 so that the image on the document surface is focused by image focusing lens 17 onto CCD 18.

The image data output from CIS 13 or CCD 18 is subjected to various kinds of image processes by a control circuit such as a microcomputer etc. and then output to printing portion 103.

Printing portion 103 is to record the document images represented by image data on sheets of paper and includes a photoreceptor drum 21, a charger 22, an exposure unit 23, a developing device 24, a transfer unit 25, a cleaning unit 26, a fixing unit 27 and the like.

While photoreceptor drum 21 rotates in one direction, its surface is cleaned by cleaning unit 26 and then charged uniformly by charger 22. Charger 22 may be either a corona discharge type or a roller or brush type that contacts with photoreceptor drum 21.

Exposure unit 23 is a laser scanning unit (LSU) including two laser emitters 28*a* and 28*b* and two mirror groups 29*a* and 29*b*. This exposure unit 23 receives image data and emits laser beams from laser emitters 28*a* and 28*b* in accordance with the image data. These laser beams are radiated on photoreceptor drum 21 by way of respective mirror groups 29*a* and 29*b* to thereby illuminate the photoreceptor drum 21 surface that has been uniformly electrified, forming an electrostatic latent image on the photoreceptor drum 21 surface.

In order to achieve a high-speed printing operation, this exposure unit 23 employs a two-beam system including two laser emitters 28*a* and 28*b* to thereby reduce the burden entailing the high frequency of irradiation.

Here, as the exposure unit 23, an array of light emitting elements, e.g., an EL writing head or LED writing head may be used instead of the laser scanning unit.

Developing device 24 supplies toner to the photoreceptor drum 21 surface to develop the electrostatic latent image into a toner image on the photoreceptor drum 21 surface. Transfer unit 25 transfers the toner image on the photoreceptor drum 21 surface to the recording paper that is conveyed by recording paper conveyor 104. Fixing unit 27 heats and presses the recording paper to fix the toner image onto the recording paper. Thereafter, the recording paper is further conveyed by recording paper conveyor 104 and discharged to a paper output tray 47. In this while, cleaning unit 26 removes and collects the toner left over on the photoreceptor drum 21 surface after transfer.

Here, transfer unit 25 includes a transfer belt 31, drive roller 32, driven roller 33, elastic conductive roller 34 and the like, and circulates transfer belt 31 by supporting and tensioning the belt on the aforementioned rollers 32 to 34 and other rollers. Transfer belt 31 has a predetermined resistivity (e.g., $1\times10^{9}$ to $1\times10^{13}$ Ω·cm) and conveys the recording paper placed on its surface. Elastic conductive roller 34 is pressed against the photoreceptor drum 21 surface with transfer belt 31 in between, so as to press the recording paper on transfer belt 31 against the photoreceptor drum 21 surface. Applied to this elastic conductive roller 34 is an electric field that has a polarity opposite to the charge of the toner image on the photoreceptor drum 21 surface. This electric field of the opposite polarity causes the toner image on the photoreceptor drum 21 surface to transfer to the recording paper on transfer belt 31. For example, when the toner image bears negative (−)

charge, the polarity of the electric field applied to elastic conductive roller 34 is set to be positive (+).

Fixing unit 27 includes a heat roller 35 and pressing roller 36. A heater is arranged inside heat roller 35 in order to set the heat roller 35 surface at a predetermined temperature (fixing temperature: approximately 160 to 200 deg. C.). A pair of unillustrated pressing members are arranged at both ends of pressing roller 36 so that pressing roller 36 comes into pressing contact with heat roller 35 with a predetermined pressure. As the recording paper reaches the pressing contact portion called as the fixing nip portion between heat roller 35 and pressing roller 36, the unfixed toner image on the recording paper is fused and pressed while it is being conveyed by the rollers 35 and 36, so that the toner image is fixed to the recording paper.

Recording paper conveyor 104 includes plural pairs of conveying rollers 41 for conveying recording paper, a pair of registration rollers 42, a conveyance path 43, an inversion/conveyance path 44, a plurality of branch claws 45, a pair of paper discharge rollers 46 and the like.

Conveyance path 43 receives recording paper from paper feeder 105 and conveys the recording paper until its leading end reaches registration rollers 42. Since registration rollers 42 are temporarily suspended at that timing, the leading end of the recording paper reaches and abuts registration rollers 42 so that the recording paper bends. The resiliency of this bent recording paper makes the front edge of the recording paper substantially parallel to registration rollers 42. Thereafter, registration rollers 42 start rotating so as to convey the recording paper to transfer unit 25 of printing portion 103 and then is further conveyed by paper discharge rollers 46 to paper output tray 47.

Suspension and rotation of registration rollers 42 can be controlled by switching on and off the clutch between registration roller 42 and its drive shaft or by turning on and off the motor as the drive source of registration rollers 42.

When another image is recorded on the rear side of the recording paper, a plurality of branch claws 45 are turned to switch the paper path from conveyance path 43 to inversion/conveyance path 44 so that the recording paper is turned upside down and returned through inversion/conveyance path 44 to registration roller 42 in conveyance path 43. In this way, another image is recorded on the rear side of the recording paper.

Arranged at the necessary positions along conveyance path 43 and inversion/conveyance path 44 are several sensors for detecting the recording paper position etc., and based on the position of the recording paper detected at each sensor, the drives of the conveying rollers and registration rollers 42 are controlled so as to convey and position the recording paper.

Paper feeder 105 includes a plurality of paper feed trays 51. Each paper feed tray 51 is a tray for holding a stack of recording sheets and is arranged under image forming apparatus 100. Also, each paper feed tray 51 includes a pickup roller or the like for pulling out recording paper, one sheet at a time so as to deliver the picked up recording paper to conveyance path 43 of recording paper conveyor 104.

Since image forming apparatus 100 of the present embodiment is aimed at high speed printing jobs, each paper feed tray 51 has a volume capable of stacking 500 to 1500 sheets of recording paper of a regular size.

Arranged on the flank of image forming apparatus 100 are a large capacity paper cassette (LCC) 52 for accommodating large amounts of plural types of recording paper and a manual feed tray 53 for essentially supplying recording paper of irregular sizes.

Paper output tray 47 is arranged on the side opposite from manual feed tray 53. It is also possible to optionally provide an output paper finisher (for stapling, punching, etc.) or a multi-bin paper output tray, in place of this paper output tray 47.

Figure 3:
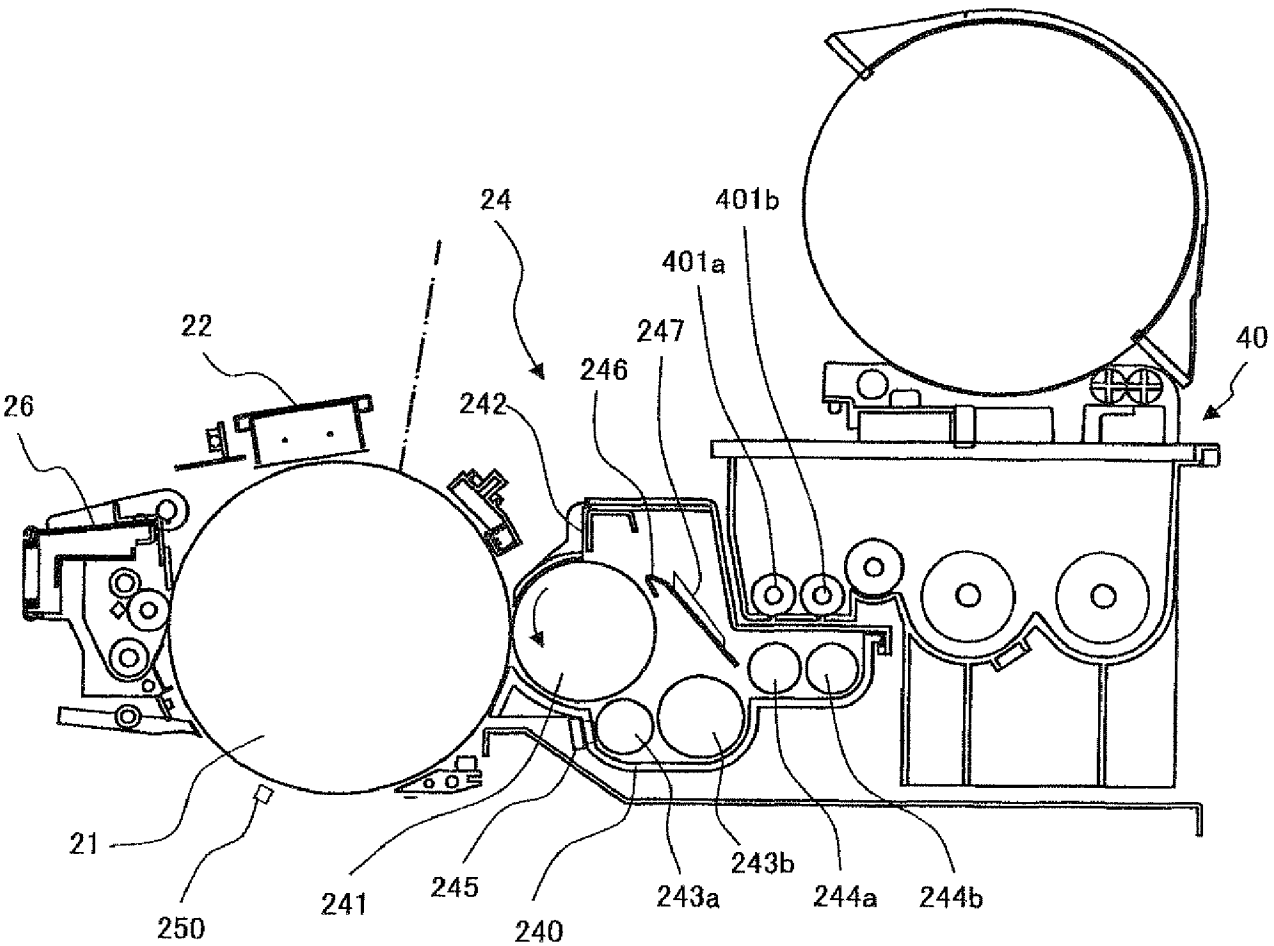
FIG. 3 is an enlarged view schematically showing a configuration around a developing device provided for the image forming apparatus.

Next, the developing device that characterizes the embodiment of the present technology will be described with reference to the drawings. FIG. 3 is an enlarged view schematically showing a configuration around the developing device provided for the image forming apparatus according to the embodiment of the present technology.

Developing device 24 of this embodiment has the function of developing the electrostatic latent image that has been formed on the surface of the image bearer, i.e., photoreceptor drum 21 by exposure unit 23 to form a visual image with toner. As shown in FIG. 3, developing device 24 includes a toner supply portion 40, a developing hopper 240, a developing roller 241, a layer thickness-regulating member 242, agitating rollers 243 (243*a*, 243*b*), toner agitation rollers 244 (244*a*, 244*b*), a toner concentration sensor 245, a flow-guide plate 246 and partitioning ribs 247.

Developing hopper 240 is a container formed of, for example, a hard synthetic resin, rotatably supporting developing roller 241, agitating rollers 243*a* and 243*b* and toner agitation rollers 244*a* and 244*b* to hold toner supplied from toner supply portion 40. In the present embodiment, toner concentration sensor 245 is arranged at a position near agitating roller 243*a* that is located close to developing roller 241 in developing hopper 240 in order to detect the toner concentration of the developer immediately before development that will directly contribute to the development.

In order to obtain the exact toner concentration of the dual-component developer that actually contributes to development by detecting the toner concentration immediately before supply to developing roller 241, toner concentration sensor 245 is disposed in proximity to agitating roller 243*a*. As an example of toner concentration sensor 245, a high-precision magnetic permeability sensor, e.g., TS-L, TS-A and TS-K (trade names of products of TDK Corporation) may be used. The measurement of the toner concentration by toner concentration sensor 245 is output to an unillustrated controller provided for image forming apparatus 100. Since the above arrangement of toner concentration sensor 245 at a position immediately before bringing up the developer to developing roller 241 enables detection of the toner concentration immediately before development, it is possible to realize high image quality over a long period of time.

Developing roller 241 is arranged opposing photoreceptor drum 21 and serving as a developer support for supporting the developer that was mixed and agitated inside developing hopper 240 and supplies toner to the developing area where the electrostatic latent image on photoreceptor drum 21 surface resides as it is rotating in the direction of the arrow shown in FIG. 3 (in the counterclockwise direction in FIG. 3).

Agitating rollers 243*a* and 243*b* are the agitating and conveying members which convey the developer toward developing roller 241 while agitating the dual-component developer of electrostatic toner and magnetic carrier by their rotational drive in developing hopper 240 and which have the developer in developing hopper 240 carried on developing roller 241. The agitating rollers also mix up the developer with the surplus developer that flows down from flow-guide plate 246 and convey the mixture toward developing roller 241.

Toner agitation rollers 244*a* and 244*b* are the rollers that agitate mainly the toner that has fallen from toner supply rollers 401*a* and 401*b* of toner supply portion 40 located over and above developing hopper 240 and convey the toner in developing roller 240.

Layer thickness-regulating member 242 regulates the amount of the developer carried on developing roller 241 to a predetermined thickness while forming a developer spike from the surplus developer that was rejected by the layer thickness-regulating member 242 and moves the spike toward flow-guide plate 246 which is located on the right side in FIG. 3.

Flow-guide plate 246 is a flow-guide plate member that flows down the surplus developer that was rejected by layer thickness-regulating member 242 toward and between agitating roller 243*b* and toner agitation roller 244*a*, which are located away from layer thickness-regulating member 242. The surplus developer having transferred over flow-guide plate 246 slides down over the slope of flow-guide plate 246 and flows down toward and between agitating roller 243*b* and toner agitation roller 244*a*.

Partitioning rib 247 is a diffusing element that flows the surplus developer downward in the predetermined direction whilst diffusing the developer with respect to the longitudinal direction of developing roller 241. There are a plurality of partitioning ribs 247 arranged upright on flow-guide plate 246. In the present embodiment, the drive of partitioning ribs 247 is controlled so that the direction in which the surplus developer flows down is made to change. The configuration of the downflow direction control mechanism and the switching drive control for turning the downflow direction of the surplus developer by partitioning ribs 247 will be described later.

Arranged around photoreceptor drum 21, close to the approximate center of the cylindrical axis of the photoreceptor drum 21 is a photosensor 250, as shown in FIG. 3. This photosensor 250 is provided as an image density detecting means so as to detect the density of the image actually developed by detecting the image density of a toner patch formed on photoreceptor drum 21.

Specifically, photosensor 250 employs a 2PD (photo diode) scheme of mirror reflection type and diffusion reflection type sensors so as to be able detect the amount of toner with high precision.

The toner patch formed on photoreceptor drum 21 is comprised of a 40 mm square patch that is positioned in the approximate center of the cylindrical axis of photoreceptor drum 21. This toner patch is measured on optical reflection density by photosensor 250 so as to determine the amount of toner (development performance).

Specifically, a relational table for presenting the relationship between the output measurement from photosensor 250 and the value of reflection density is previously prepared, and the value of reflection density is measured. Further, a relational table for presenting the relationship between the reflection density and the development bias voltage is previously prepared, whereby it is possible to control the development bias voltage so as to obtain the optimal reflection density.

Next, the configuration and operation of the downflow direction control mechanism provided for the developing device in the present embodiment will be specifically described.

Figure 4:
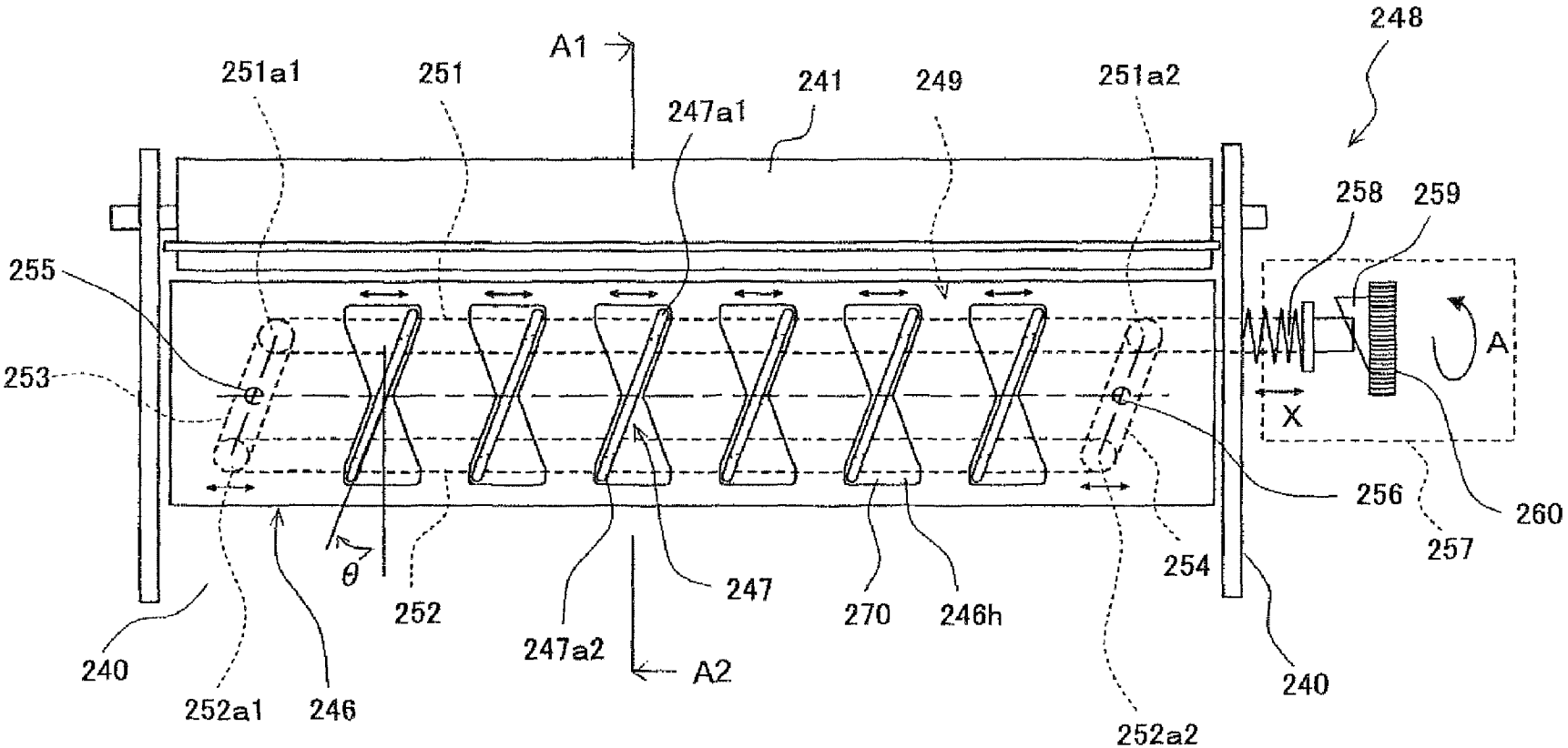
FIG. 4 is a top illustrative view schematically showing the developing device with its top cover removed.
Figure 5:
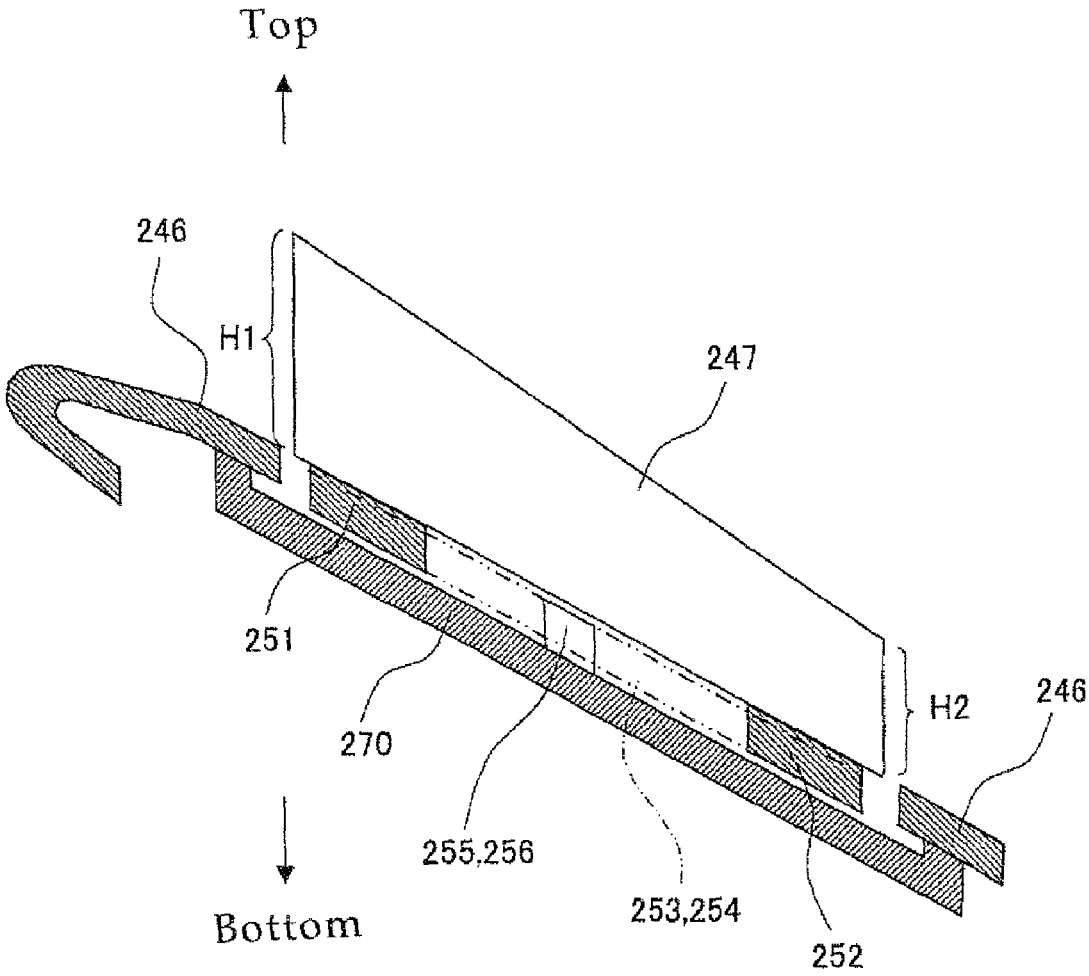
FIG. 5 is a sectional view, cut along a plane A1-A2 in FIG. 4.
Figure 6:
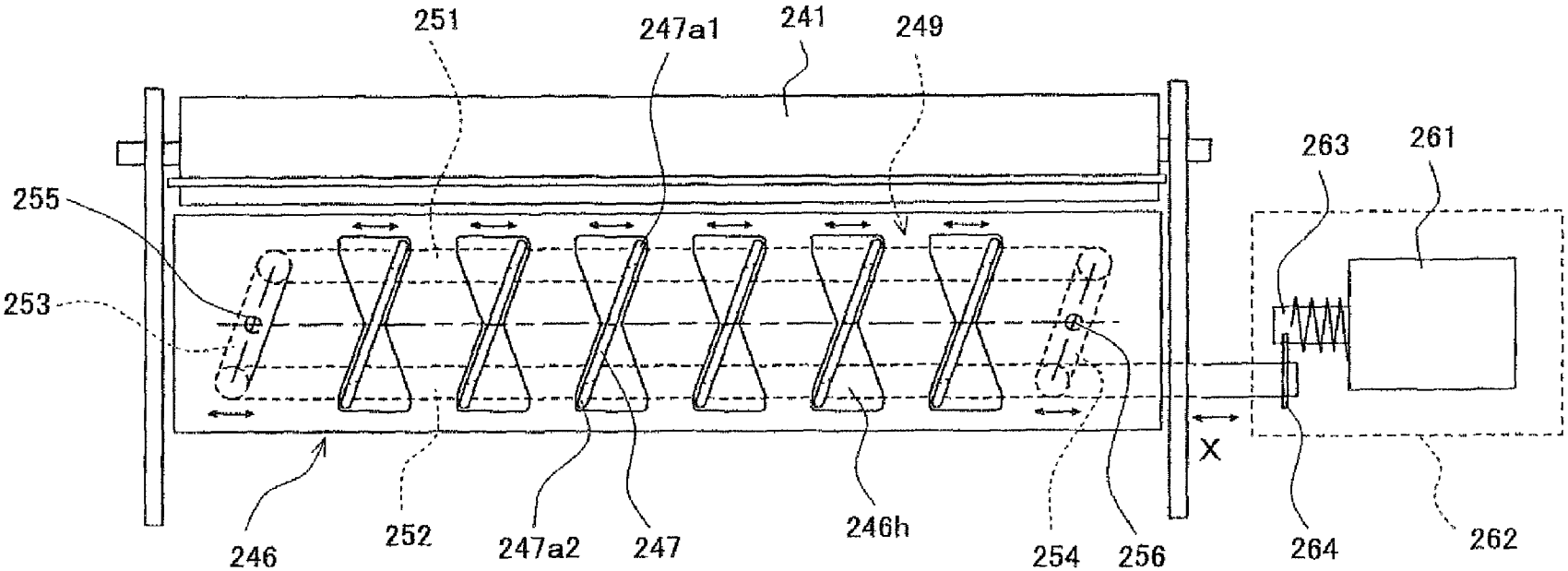
FIG. 6 is an illustrative top view schematically showing a variational example of the developing device with its top cover removed.

FIG. 4 is a top illustrative view schematically showing the developing device of the present embodiment with its top cover removed, FIG. 5 is a sectional view, cut along a plane A1-A2 in FIG. 4, and FIG. 6 is an illustrative top view schematically showing a variational example of the developing device with its top cover removed.

As described above, in this embodiment, a plurality of (six in the example shown in FIG. 4) partitioning ribs 247 are provided approximately parallel to each other. These partitioning ribs 247 are driven and controlled by a downflow direction control mechanism 248 so as to change the downflow direction of the surplus developer.

Each partitioning rib 247 is pivotally supported at both ends 247*a*1, 247*a*2 on their proximal sides by a pair of supporting rod members 251 and 252 which are arranged on the side (underside) of flow-guide plate 246 opposite from the side where the ribs are projected upright. These supporting rod members 251 and 252 are pivotally supported at both ends thereof, designated at 251*a*1 and 251*a*2, and at 252*a*1 and 252*a*2, respectively, by a pair of connection rod members 253 and 254, forming a set of linkage mechanism 249 made up of a pair of supporting rod members 251 and 252 and a pair of connecting rod members 253 and 254.

Connecting rod members 253 and 254 are rotationally supported at their approximately centers by fulcrums 255 and 256, respectively, so as to reciprocate supporting rod members 251 and 252 in the longitudinal direction of developing roller 241 (the X-direction shown in FIG. 4) pivoting on the two fulcrums 255 and 256.

Further, in the present embodiment, a reciprocation drive mechanism 257 for moving supporting rod member 251 in the longitudinal direction (the X-direction shown in FIG. 4) of developing roller 241 is disposed outside developing hopper 240. This reciprocation drive mechanism. 257 is comprised of a power transmitter 258 such as a plunger etc. for moving supporting rod member 251 in the X-direction, a gear 260 having a tapered element 259 that abuts the power transmitter 258 and an unillustrated drive motor that rotates gear 260 in the direction of A shown in FIG. 4. That is, supporting rod members 251 and 252 of linkage mechanism 249 are moved in the X-direction, pivoting on two fulcrums 255 and 256, by the rotational drive of gear 260. With the thus constructed reciprocation drive mechanism 257, six partitioning ribs 247 are pivotally supported by supporting rod member 251 that is supported at both ends 251*a*1 and 251*a*2 and supporting rod member 252 that is supported at both ends 252*a*1 and 252*a*2, so that both ends 247*a*1 and 247*a*2 of each partitioning rib 247 can reciprocate in the X-direction. Accordingly, it is possible to control the regulating direction of partitioning ribs 247 for regulating the downflow direction of surplus developer flowing down over guide-plate 246.

In the above way, in the present embodiment, downflow direction control mechanism 248 is constructed so that reciprocation drive mechanism 257 causes supporting rod members 251 and 252 of linkage mechanism 249 to reciprocate in the X-direction, pivoting on two fulcrums 255 and 256, it is hence possible to change the regulating direction of partitioning ribs 247 which are rotatably supported at their ends on supporting rod members 251 and 252.

Further, flow-guide plate 246 is formed with cutouts 246*h* having a sandglass-like shape as shown in FIG. 4, in the areas corresponding to the reciprocating motion of partitioning ribs 247, so that partitioning ribs 247 will not be hindered in their reciprocating motion.

Also, as shown in FIG. 5, a surplus developer receiver 270 for preventing the surplus developer flowing over flow-guide plate 246, from falling is provided under the area where cutouts 246*h* are formed in flow-guide plate 246.

Partitioning rib 247 is formed so that its height H1 is greater (6 mm as an example) on the side closer to layer thickness-regulating member 242 (on the left side in FIG. 5) and its height H2 smaller (3 mm as an example) on the side more distant from layer thickness-regulating member 242 (on the right side in FIG. 5). That is, since a certain amount of surplus developer is returned from developing roller 241 in the area close to the layer thickness-regulating member 242 (on the left side in FIG. 5), each partitioning rib 247 of the present embodiment needs to be equal to or higher than a certain height so as not to allow the developer to converge to a particular partitioning rib 247 and so as to make the amount of the developer in each passage between partitioning ribs 247 uniform. On the other hand, in the rear half of the flowing movement of the surplus developer over flow-guide plate 246, the height of the collection of developer has been made substantially even also by the function of the reciprocating movement of partitioning ribs 247, so that each partitioning rib 247 is formed to be low so as to allow the developer in each passage between partitioning ribs 247 to mix with that in adjacent passages. The formation of partitioning ribs 247 so that their height from the flow-guide plate 246 surface becomes lower in the above way as it goes downstream, makes it possible to positively distribute the surplus developer on the entrance side of flow-guide plate 246 and make the surplus developer in adjacent passages between partitioning ribs 247 mix up by lowering partitioning ribs 247 in the rear half thereof. As a result, it is possible to make the toner concentration uniform with a higher precision.

As another example of the reciprocation drive mechanism for driving linkage mechanism 249, a reciprocation drive mechanism 262 using a solenoid 261 as shown in FIG. 6 may be used. Illustratively, a plunger 263 of solenoid 261 is made to expand or contact so as to cause a supporting rod member 252 of linkage mechanism 249 to reciprocate in the X-direction by means of a drive transmitter 264 with which plunger 263 is engaged, whereby the ends 247*a*1 and 247*a*2 of each partitioning rib 247 reciprocate with respect to fulcrums 255 and 256. In other words, supporting rod member 252 of linkage mechanism 249 moves reciprocatingly in the X-direction so as to change the regulating direction of partitioning ribs 247 for regulating the surplus developer that flows down over flow-guide plate 246.

Next, examples and comparative examples for determining suitable set conditions for an image forming (printing) operation with the developing device of the present embodiment will be described.

Figure 7B:
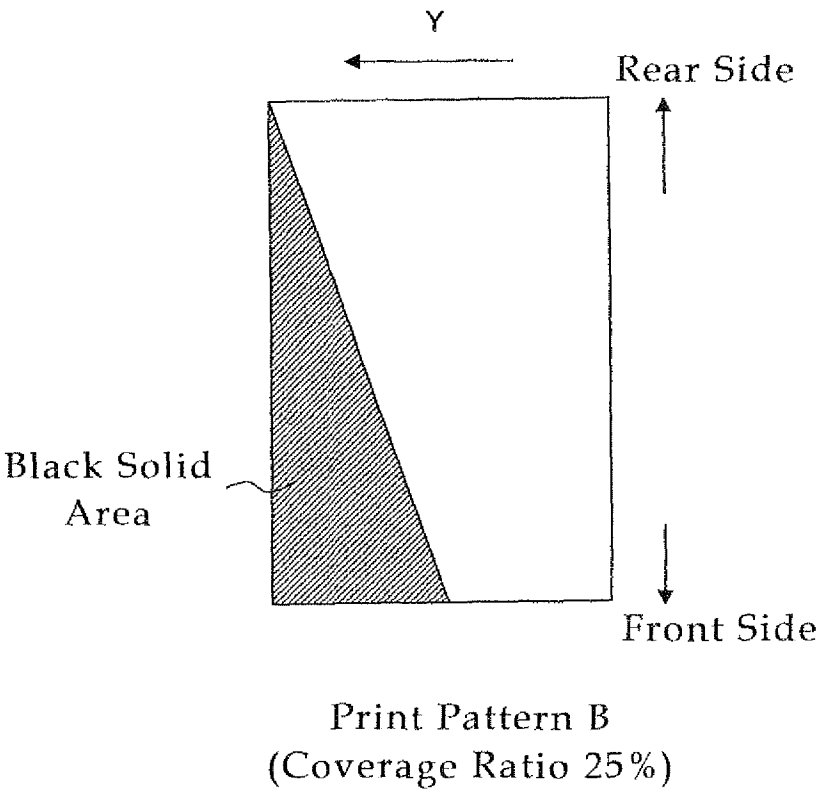
FIG. 7 shows a print pattern used for evaluation on examples for determining suitable set conditions for a printing operation using the developing device, FIG. 7A an illustrative view showing a print pattern A including a 12.5% black solid area in A4-sized document, FIG. 7B an illustrative view showing a print pattern B including a 25% black solid area in A4-sized document; and, FIG. 8 is a table showing the set conditions in examples and comparative examples and evaluation on image quality to determine suitable set conditions for a printing operation using the developing device.
Figure 7A:
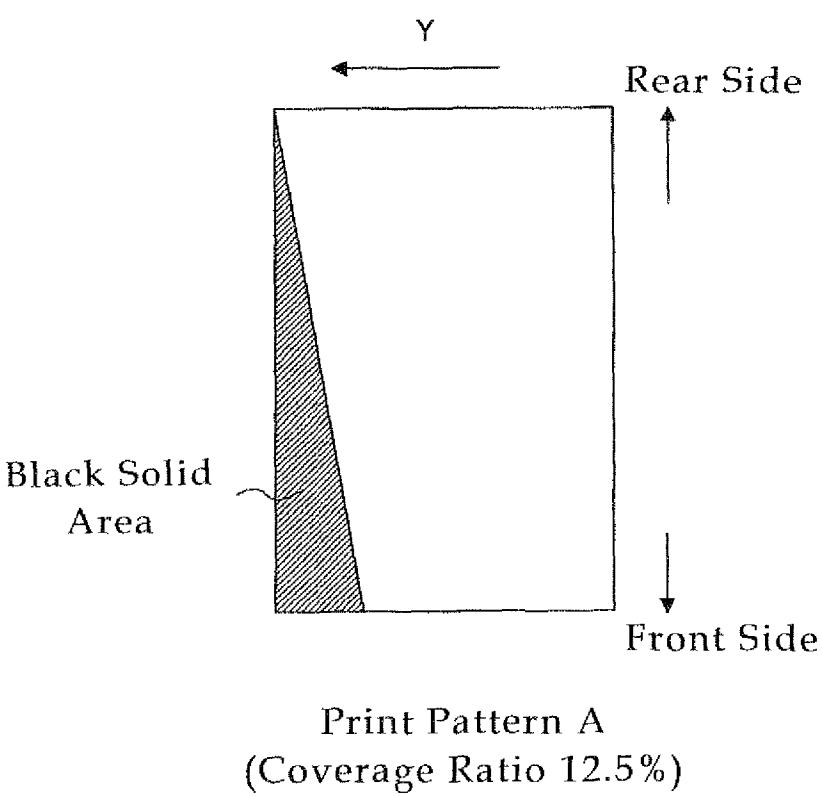

FIG. 7 shows a print pattern used for evaluation on the examples for determining suitable set conditions for a printing operation using the developing device of the present embodiment, FIG. 7A an illustrative view showing a print pattern A including a 12.5% black solid area in A4-sized document, FIG. 7B an illustrative view showing a print pattern B including a 25% black solid area in A4-sized document. FIG. 8 is a table showing the set conditions in examples and comparative examples and evaluation on image quality to determine suitable set conditions for a printing operation using the developing device of the present embodiment.

As shown in FIGS. 7A and 7B, two print patterns A and B are used in the examples, each of which has a black solid area that becomes greater in a sloping manner from the rear side to the front side in the drawing along the direction substantially perpendicular to the paper conveying direction (the direction of arrow Y) or along the axial direction (longitudinal direction) of developing roller 241. Print pattern A is specified to include a 12.5% black solid sloping area in A4-sized document, and print pattern B is specified to include a 25% black solid sloping area in A4-sized document.

When print patterns A and B shown in FIGS. 7A and 7B are used, toner consumption varies along the longitudinal direction of developing device 24 (along the axial direction of developing roller 241). More explicitly, toner consumption is greater in the front side of the developing hopper 240 than in the rear side. Since, in the conventional configuration, the method of supplying toner to developing device 24 is essentially unvaried along the longitudinal direction, if this print pattern has been continuously printed, the toner concentration on the front side becomes lower.

To deal with this, in the present embodiment, the downflow direction of the surplus developer regulated by partitioning ribs 247 is inclined toward the rear side of developing hopper 240 so that a greater amount of developer fall on the rear side. As a result, the toner agitating and mixing effect due to the surplus developer falling toward the rear side is improved. Further, since the amount of developer on the rear side increases, the effect of the developer to push the toner toward the front side is enhanced. Accordingly, it is possible to reduce the time required to make the toner concentration uniform.

Examples 1 and 2 and Comparative Examples 1 and 2

In examples 1 and 2, print patterns A and B receptively having 12.5% and 25% black solid areas that are printed in a sloping manner along the longitudinal direction of developing device 24 in an A4-sized document as shown in FIG. 7, were used to perform continuous printing tests of 500 sheets in the above-described developing device 24 of the first embodiment with a dual-component developer containing 6% toner, under the condition that the inclined angle θ of partitioning ribs 247 (FIG. 4) was set at 10° for print pattern A and set at 20° for print pattern B. After continuous printing of 500 sheets, the developer in the upper part of toner agitation roller 244*b* was sampled to measure toner concentration.

In measuring toner concentration, a solvent method was used, and toner concentration was measured at three points, namely, front side (F), center (C) and rear side (R) in developing hopper 240. The test was done with developing roller 241 driven at a rotational speed of 864 mm/sec. Evaluation on the image quality after 500 printouts was done based on the variation of the printed density at the central part using a reflective densitometer (RD918: a product of MACBETH) for evaluation.

Further, as comparative examples 1 and 2, similar evaluation tests in the same manner as examples 1 and 2 were carried out under the condition that partitioning ribs 347 are arranged and unmoved along the rotational direction of developing roller 341, or substantially perpendicularly to the axial direction of developing roller 341.

Example 3 and Comparative Example 3

In example 3, a continuous printing test of 500 sheets was performed using print pattern B having a 25% black solid area in an A4-sized document, in the same manner as in example 1 except that the rotational speed of developing roller 241 was set at 432 mm/sec. After continuous printing of 500 sheets, the developer in the upper part of toner agitation roller 244*b* was sampled to measure toner concentration in the same manner. Further, evaluation on the image quality after 500 printouts was made similarly by evaluating the variation of the printed density at the center (C).

Further, as comparative example 3, a similar evaluation test as comparative examples 1 and 2 was carried out under the condition that the partitioning ribs 347 were unmoved.

Examples 4 to 6

In examples 4 to 6, continuous printing tests of 500 sheets were performed using a print pattern A having 12.5% black solid area in an A4-sized document, in the same manner as in examples 1 to 3, except that the rotational speed of developing roller 241 was set at 864 mm/sec, developing roller 241 was continuously driven for 30 min (example 4) or for 60 min (examples 5 and 6), and the printing operation was suspended every 15 minutes and ten reciprocating movements of the partitioning ribs were added. After the continuous printing, the developer in the upper part of toner agitation roller 244*b* was sampled to measure toner concentration. Further, evaluation on the image quality at the end of printing was made similarly to examples 1 to 3 by evaluating the variation of the printed density at the center (C). In example 6, no reciprocating movement of the partitioning ribs was added.

The results of the above examples and comparative examples will be described.

As to evaluation of toner concentration, as long as the difference fell within 0.1 wt % in absolute value or the difference in image density fell within 0.1, the result was regarded as a practically permissible level or OK level.

As in Table 1 in FIG. 8, it was found from the comparison between examples 1 and 2 and comparative examples 1 and 2 that the difference in toner concentration between the front and rear sides can be suppressed and sharp printed images can be obtained, by changing the downflow direction of partitioning ribs 247 provided for flow-guide plate 246, or by increasing the inclined angle θ of the downflow direction of partitioning ribs 247 with increase of the black solid area (coverage ratio).

That is, if, as a usual case, unbalanced print patterns continue as a print job, the toner concentration may become locally uneven across the length of developing roller 241. However, it was found that even in such a case, if an unillustrated controller of image forming apparatus 100 is constructed so that downflow direction control mechanism 248 controls or changes the downflow direction that is regulated by partitioning ribs 247, in accordance with the toner consumption used for development along the longitudinal direction of developing roller 241 when there is an extreme difference in the print pattern between the front and rear sides, it is possible to make the toner concentration uniform with a higher precision.

It was also found from the comparison between examples 2, 3 and comparative example 3 that the difference in toner concentration between the front and rear sides can be suppressed and sharp printed images can be obtained, by adding reciprocating movement of partitioning ribs 247 and also by increasing the inclined angle θ of partitioning ribs 247 with increase of the rotational speed of developing roller 241.

That is, it is usual that the rotational speed of developing roller 241 is changed with the change of the processing speed of forming images on print paper. However, as the processing speed is increased, the mixing and agitation performance of the dual-component developer lowers. To deal with this situation, it was found that if controller 40 of image forming apparatus 100 is adapted to control to increase the inclined angle θ of the downflow direction by downflow direction control mechanism 248, it is possible to make toner concentration uniform with a higher precision.

Further, it was found from examples 4 and 5 that the difference in toner concentration between the front and rear sides can be suppressed and sharp printed images can be obtained, by performing additional reciprocating movement of the partitioning ribs if the continuous drive time of developing roller 241 becomes long.

That is, it is usual that the fluidity and the mixing and agitation performance of the dual-component developer become lowered as use of the developer becomes longer. To deal with this situation, it was found that if controller 40 of image forming apparatus 100 is adapted to adjust the downflow direction by partitioning ribs 247 to one direction in accordance with the continuous drive time of developing roller 241, it is possible to make toner concentration uniform with a higher precision.

From the above result of the examples and comparative examples, it was found that the surplus developer that flows down can be uniformly diffused with respect to the longitudinal direction of the developer support, i.e., developing roller 241 and the mixing and agitation performance in the developing hopper can be improved since in the developing device of the present technology, the downflow direction control mechanism controls the downflow direction in which the surplus developer that is collected by, and flows down, over the flow-guide plate, is regulated by the partitioning ribs. Accordingly, it was found that image unevenness originating from the developing device can be prevented since toner concentration can be made uniform across the length of developing roller 241.

Having described the preferred embodiment of the present technology with reference to the attached drawings, it goes without saying that the present technology should not be limited to the above-described examples, and it is obvious that various changes and modifications will occur to those skilled in the art within the scope of the appended claims. Such variations are therefore understood to be within the technical scope of the present technology.

For example, in the above embodiment, the developing device of the present technology is applied to a monochrome image forming apparatus having one toner cartridge mounted therein, but the developing device of the present technology can also be applied to a color image forming apparatus.

What is claimed is:

1. A developing device for developing an electrostatic latent image formed on an image bearer with a developer that has been triboelectrically-charged by mixing and agitation of two components, toner and magnetic carrier, comprising:

a developing hopper for storing the developer;

an agitation and conveying member that is rotationally driven inside the developing hopper for conveying the developer while agitating;

a developer support which supports the developer that has been mixed and agitated inside the developing hopper and supplies the developer whilst being rotationally driven to a developing area located opposing the image bearer;

a layer thickness-regulating member for regulating the layer thickness of the developer being conveyed by the developer support;

a flow-guide plate member for flowing down the surplus developer that was rejected by the layer thickness-regulating member to a place located away from the layer thickness-regulating member;

a plurality of diffusing elements arranged upright on the flow-guide plate member for flowing down the surplus developer in a predetermined direction whilst diffusing the developer with respect to the longitudinal direction of the developer support; and a downflow direction control mechanism for controlling the downflow direction of the surplus developer by the diffusing elements, in accordance with the coverage ratio of black solid area in print documents with respect to the longitudinal direction of the developing hopper, wherein the downflow direction control mechanism is controlled such that the angle of the downflow direction that is regulated by the diffusing elements is made greater in accordance with the rotational speed of the developer support.

2. The developing device according to claim 1, wherein the diffusing element is formed such that the height from the surface of the flow-guide plate member on which the diffusing element is set becomes smaller as it goes in the downflow direction.

3. The developing device according to claim 1, further including a toner concentration uniforming mechanism of flowing down the surplus developer while reciprocating the downflow direction control mechanism every time the continuous drive time of the developer support exceeds a predetermined period of time.

4. The developing device according to claim 1, further comprising a toner concentration detector that is arranged in the proximity to the area where the developer is supplied from the agitating and conveying member to the developer support, to detect the toner concentration of the developer.

5. An image forming apparatus comprising an image bearer for supporting an electrostatic latent image, and a developing device according to claim 1 for visualizing the electrostatic latent image on the image bearer with toner.

6. The image forming apparatus according to claim 5, further including an image density detector for detecting the density of a toner patch on the image bearer.

* * * * *